US006203175B1

(12) United States Patent
Basacchi

(10) Patent No.: US 6,203,175 B1
(45) Date of Patent: Mar. 20, 2001

(54) BATTERY OPERATED PICTURE LIGHT

(76) Inventor: Vincent Basacchi, 61 Markbrook Lane, Apt. 908, Etobicoke, Ontario (CA), M9V 5E7

( * ) Notice: Subject to any disclaimer, the term of this patent is extended or adjusted under 35 U.S.C. 154(b) by 0 days.

(21) Appl. No.: 09/488,839

(22) Filed: Jan. 21, 2000

(51) Int. Cl.[7] ..... F22V 21/26
(52) U.S. Cl. ..... 362/287; 362/371; 362/427
(58) Field of Search ..... 362/190, 191, 362/147, 269, 285, 287, 371, 372, 401, 418, 427, 339, 432, 812; 40/715

(56) References Cited

U.S. PATENT DOCUMENTS

| | | | |
|---|---|---|---|
| D. 275,424 | 9/1984 | Albano . | |
| D. 278,555 | 4/1985 | Cummings . | |
| D. 312,703 | 12/1990 | Muller et al. . | |
| 2,161,872 | 6/1939 | Kostal | 240/6.4 |
| 2,597,662 | 5/1952 | Melamed et al. | 240/6.4 |
| 3,307,026 | 2/1967 | Kramer | 240/4 |
| 3,475,603 | 10/1969 | Gheno | 240/2 |
| 3,723,720 | 3/1973 | Schmidt et al. | 240/2 |
| 3,786,245 | 1/1974 | Cincotta et al. | 240/2 |
| 5,217,296 * | 6/1993 | Tanner et al. | 362/418 |
| 5,664,875 * | 9/1997 | Hegedus | 362/191 |

* cited by examiner

*Primary Examiner*—Y. Quach
(74) *Attorney, Agent, or Firm*—Peter R. Hammond; Ridout & Maybee

(57) ABSTRACT

A picture lamp for lighting a picture or display mounted on a picture frame includes an elongate, tubular housing capable of holding batteries therein and at least one support wing rigidly connected to a lower section of the housing and arranged to project downwardly therefrom. An elongate support arm is pivotably connected to the housing at an upper and central section thereof. An electrical light receptacle is mounted on an outer end of the support arm and is capable of holding at least one light bulb. An electrical circuit for operating the light bulb or bulbs by operatively connecting same to the batteries is provided. This circuit includes wiring extending along the support arm and a switch. The picture lamp is adapted to rest on a top portion of the picture frame.

14 Claims, 4 Drawing Sheets

BATTERY OPERATED PICTURE LIGHT

BACKGROUND OF THE INVENTION

This invention relates to illuminating devices or lamps for lighting a picture or display.

A wide variety of lamps and lighting devices are known in the lighting art, including lighting devices specifically designed for casting light on a picture or display. Lamps for pictures generally include an electric light receptacle that is mounted on a flexible or movable support arm which in turn is mounted on a connecting structure, either one designed for mounting on the wall or an adjacent support structure or one for mounting on the back of the picture or display itself. The light receptacle can comprise a metal housing generally with an open bottom and often with a reflector to direct the light in the direction of the picture. The support arm may take the form of a flexible support tube or the form of one or more rigid arm sections, the position of which can generally be adjusted.

An example of a picture frame designed for a display frame is that illustrated in U.S. Pat. No. 3,723,720 issued Mar. 27, 1973 to Magna Battery Reflector Corp. This known device employs battery power and it is detachably mounted atop a picture frame at its back by using a bracket base. This base is connected to the frame by means of a clamp mechanism that extends to the front of the frame. The device includes a lamp receptacle that acts as a reflector and a flexible goose neck conduit that is connected at its rear end to the bracket and at its front end to the light receptacle. The battery pack is mounted on a bottom of the bracket and is positioned behind the picture frame.

U.S. Pat. No. 3,786,245 issued Jan. 14, 1974 to Cincotta et al. describes a cordless picture lamp that runs on a rechargeable battery. This lamp includes a vertical mounting bracket and the battery is mounted in a horizontal support for the light source, which is angularly disposed to direct light downwardly and inwardly towards the vertical surface of the picture.

U.S. Design Pat. No. 312,703 issued Dec. 4, 1990 appears to show a picture light with a light receptacle at one end of an elongate, adjustable arm that appears to have a pivotable connection at each end. At the end furthest from the lamp receptacle there is a base housing which is generally rectangular on each side.

It is an object of the present invention to provide a relatively inexpensive illuminating device for mounting on a picture frame, which device will not result in damage either to the frame itself or the adjacent supporting wall as it requires no mounting screws and no clamping mechanism.

It is a further object of the present invention to provide an improved illuminating device or picture lamp for lighting a picture or display which can be manufactured at a reasonable cost, which is battery operated, and which employs an adjustable support arm that extends between a housing for the battery or batteries and the electric light receptacle.

SUMMARY OF THE INVENTION

According to one aspect of the invention, an illuminating device for mounting on a picture frame comprises an elongate housing capable of holding at least one battery therein and at least one support wing rigidly connected to the housing and projecting downwardly from a lower portion thereof. The housing also has a pivot pin connection on an upper side thereof and located about midway along the length of the housing. A hollow support arm is pivotably connected at an inner end thereof to the pivot pin connection and an electrical light receptacle is mounted on an outer end of this support arm and is capable of holding at least one light bulb. There is also an electrical circuit for operating the at least one light bulb by operatively connecting same to the at least one battery. The electrical circuit includes electrical wiring extending through the support arm and an on-off switch.

Preferably the elongate housing is substantially cylindrical and the at least one support wing is substantially planar and extends substantially tangentially from the lower section of the housing.

According to another aspect of the invention, a picture lamp for lighting a picture or display mounted in a picture frame to be hung on a wall includes an elongate, tubular housing capable of holding at least one battery therein and at least one support wing rigidly connected to a lower section of the housing. This support wing is arranged to project downwardly from the housing during use of the lamp. An elongate support arm is pivotably connected to the housing at an upper and central section thereof. An electrical light receptacle is mounted on an outer end of the support arm and is capable of holding at least one light bulb. There is also an electrical circuit for operating the at least one light bulb by operatively connecting same to the at least one battery. This circuit includes electrical wiring extending along the support arm and an on-off switch. The picture lamp is adapted to rest on a top portion of the picture frame when the latter has been hung on a wall. In this position, the at least one support wing can extend downwardly between the wall and a rear surface of the picture frame in order to hold the picture lamp on the top portion of the picture frame.

Preferably the tubular housing has a substantially cylindrical exterior and is capable of holding two or more batteries in an end-to-end manner.

Further features and advantages will become apparent from the following detailed description taken in conjunction with the accompanying drawings.

DETAILED DESCRIPTION OF PREFERRED EMBODIMENT

Figure 1:
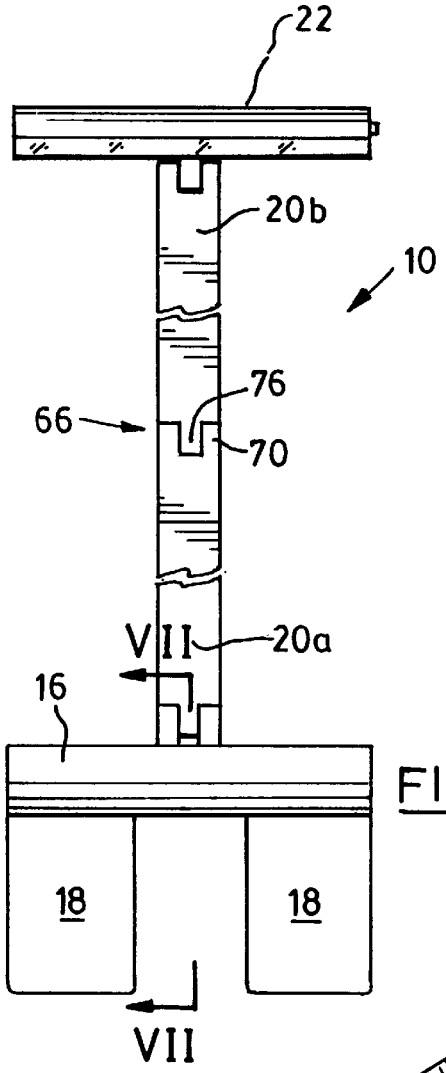
FIG. 1 is a front view of a picture lamp constructed in accordance with the invention.
Figure 2:
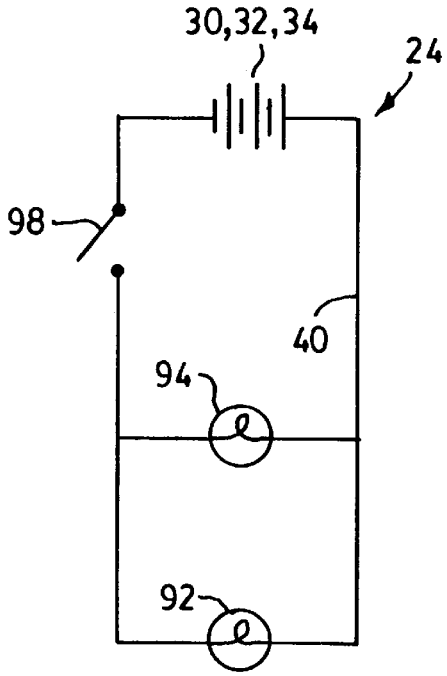
FIG. 2 is an electrical circuit diagram illustrating the electrical circuit that can be used in the picture lamp of FIG. 1.
Figure 3:
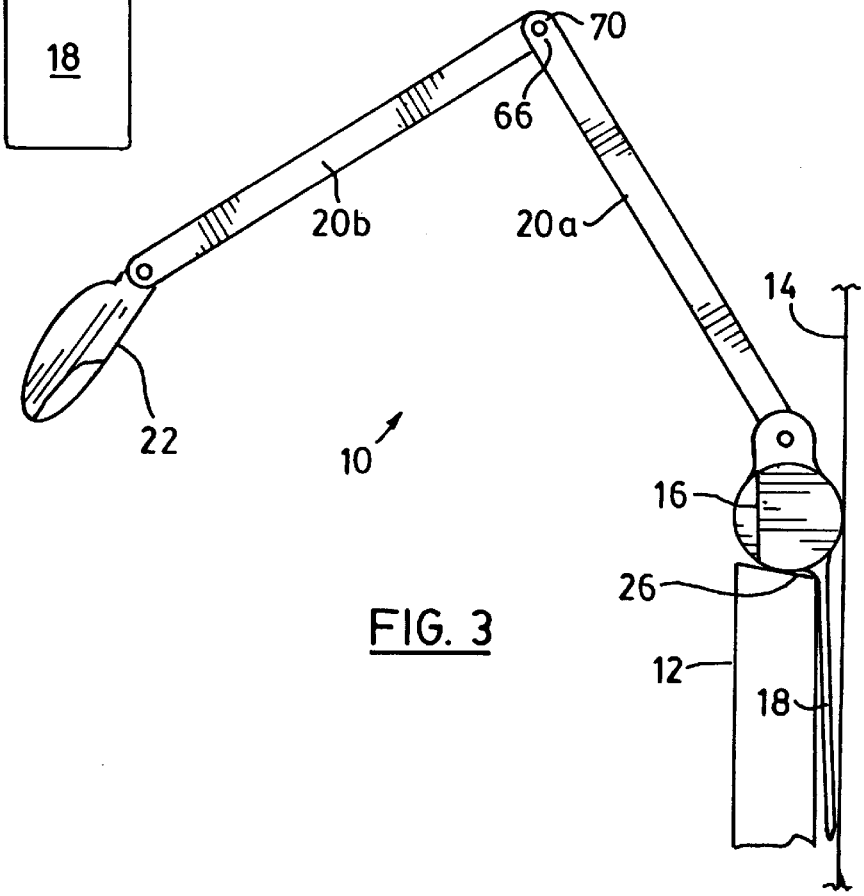
FIG. 3 is a side view of the picture lamp of FIG. 1.
Figure 4:
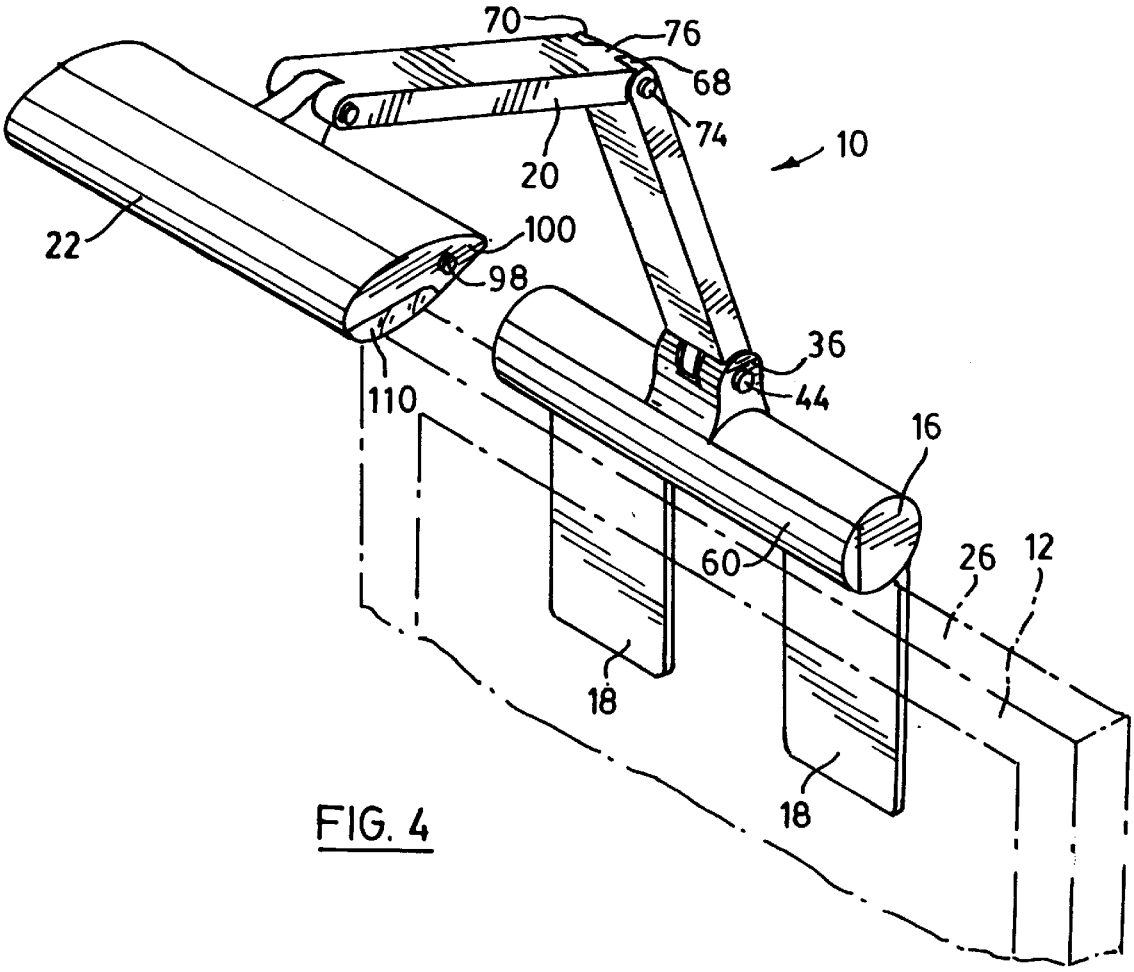
FIG. 4 is a perspective view of the picture lamp, this view being taken from the front and to one side.

As shown in FIGS. 1, 3 and 4, the present invention comprises an illuminating device or picture lamp 10 especially adapted for mounting on a picture frame 12 which can be of standard construction. This lamp 10 is constructed for the purpose of lighting a picture or display mounted in the picture frame 12 which can be hung on a vertical wall 14. It will be understood that the picture frame can be hung in the usual manner, for example, by means of picture wire and hook shaped fasteners or nails mounted on the wall, these fasteners not being shown in FIG. 3. The picture lamp of the invention comprises several major components including an elongate housing 16 capable of holding at least one battery therein and preferably two or three batteries, at least one support wing 18 rigidly connected to the housing, a support arm 20, and an electrical light receptacle 22 mounted on an outer end of the support arm. There is also an electrical circuit indicated generally at 24 in FIG. 2 for operating the one or more light bulbs of the picture lamp by operatively connecting these bulbs to the battery or batteries installed in the lamp. It will be noted that in the preferred illuminating device illustrated in the drawings, there are in fact two support wings 18 each having a generally rectangular shape and each projecting downwardly from a lower section of the housing. The preferred support wings 18 are substantially planar as shown and they extend substantially tangentially from the lower section of the housing as illustrated in FIG. 3. It will be understood that the position of the wings 18 relative to the housing enables these wings to be easily inserted between the surface of the wall 14 and the back of the picture frame 12 as shown in FIG. 3. Thus, these wings can extend downwardly between the wall and the rear surface of the picture frame in order to hold the picture lamp 10 on a top portion or top surface 26 of the picture frame. Thus, because of the positioning of the wing, the bottom surface of the battery housing can rest on the top of the picture frame and, in this way, the picture lamp will be supported by the picture frame. The preferred wings 18 are made of plastic and are integrally formed on the housing 16 when the housing is molded. The size of the wings can vary but in a preferred embodiment they are eight to ten inches in length. The two support wings are located at opposite end sections of the housing 16. It will be understood that instead of two wings, there could be a single, large support wing or there could be more than two wings. The provision of wings at opposite ends of the housing helps to provide stability for the mounting of the picture lamp.

Figure 5:
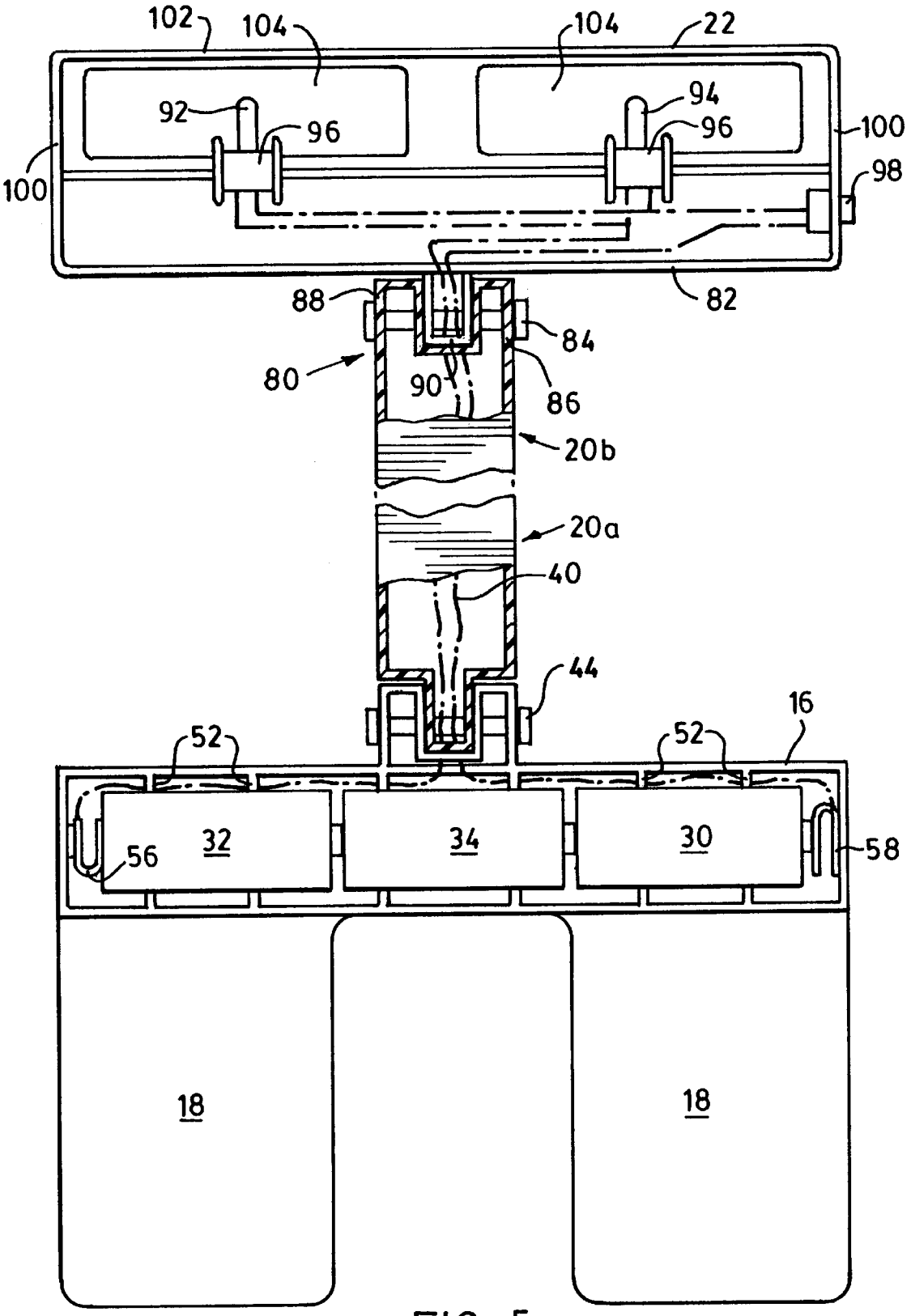
FIG. 5 is a detail front view of the picture lamp with the lamp extended upwardly and the battery cover removed.
Figure 8:
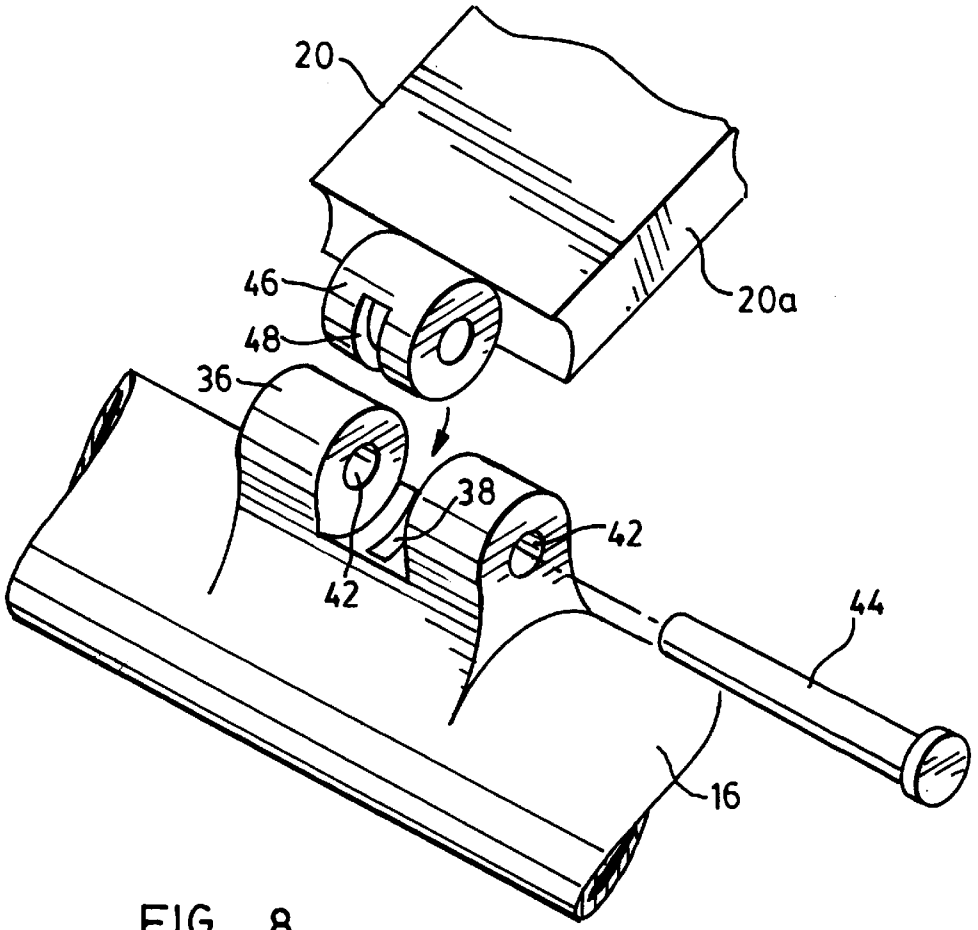
FIG. 8 is a detail view in perspective showing a pivot joint between the battery housing and a section of the support arm.

Turning now to the preferred construction of the housing itself, the illustrated housing is hollow and is capable of holding three batteries 30, 32 and 34 in end-to-end alignment as shown in FIG. 5. The size and type of battery will depend on the size of the lamp and its intended use. The preferred batteries of the illustrated lamp can be AA batteries. The housing 16 has a pivot arm connection 36 on an upper side thereof and located midway along the length of the housing. The support arm 20, which is preferably hollow, is pivotably connected at an inner end thereof to the pivot pin connection 36 which projects upwardly from the upper side of the housing. The connection 36 is on either side of a wire passageway 38 for passage of electrical wiring therethrough. This wiring 40 is part of the aforementioned electrical circuit 24. The connection 36 can be an integral lug-type connector that is formed when the housing is molded and thus it is made from plastic. This connector has a pivot pin hole 42 and a suitable pivot pin 44 made of plastic or metal extends through both sections of the connector as well as through connecting section 46 integrally formed on the inner end of the support arm. The connecting section 46 is formed with a wire slot 48 through which the aforementioned wiring 40 can extend from the inside of the support arm 20 and into the housing 16.

Figure 7:
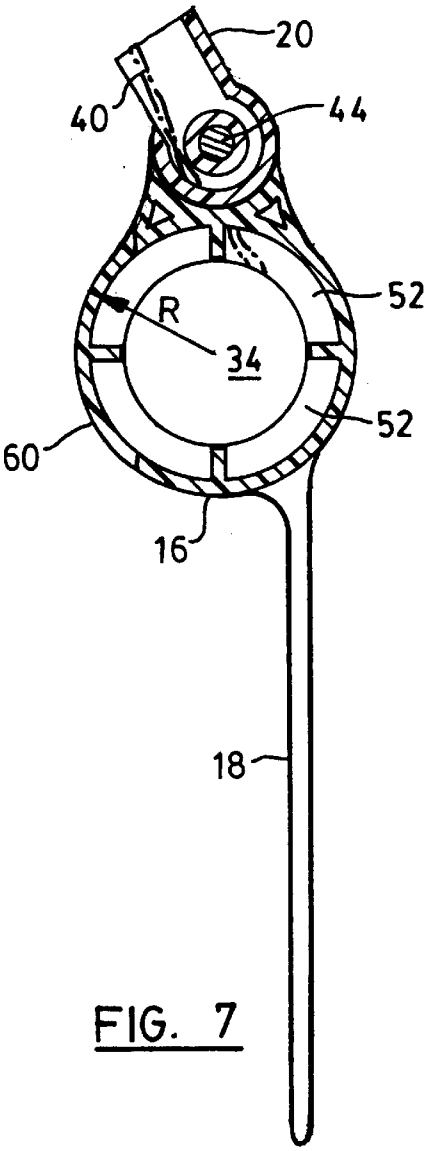
FIG. 7 is a cross-sectional elevation taken along the line VII—VII of FIG. 1.

The interior of the housing 16 can be seen in FIG. 5 which shows the three batteries mounted therein. The elongate housing 16 as shown is substantially cylindrical both on its exterior and on the interior. However, inside the housing there can be a number of circumferentially extending ribs 52 which not only support and locate the three batteries but also help strengthen the housing itself. Also, mounted at opposite ends of the housing are metallic spring contacts 56 and 58 which are electrically connected to the wiring 40. In order to gain access to the battery compartment in the housing, there is a battery cover 60 which, as illustrated in FIGS. 4 and 7 is located on the front side of the housing. The battery cover can be secured to the housing in the usual manner, for example by means of short projecting legs that extend into the main body of the housing and a spring clip (not shown). As the construction of battery covers are well known in the art of battery operated appliances, a detailed description herein is deemed unnecessary. The preferred illustrated battery cover is curved in the transverse direction of the housing with its exterior radius of curvature, indicated by R in FIG. 7, corresponding substantially to that of the housing 16.

Turning now to the support arm 20, the preferred illustrated arm has a first elongate arm section 20A and a second elongate arm section 20B. These two sections are pivotably connected to each other at a joint 66. Preferably this joint is located about midway along the length of the support arm 20. The arm section 20A can have two, separated pivot pin holding sections 68 and 70. Each of these sections has a pivot pin hole (not shown) through which can extend a suitable pivot pin 74 made of metal or a suitably strong plastic. The second arm section 20B can have a centrally located pivot pin holding section 76 formed with a pivot pin hole and a central slot for wiring (not shown). Thus, the wiring 40 that passes through the arm sections 20A and 20B can pass through the central slot and thus will be hidden from view. The preferred illustrated arm sections are hollow, tubular members so that the wiring cannot be seen. As illustrated, these arm sections have a rectangular transverse cross-section but it will be appreciated that the cross-section could also be square and it can be made round as well, if desired. Instead of using hollow, tubular arm sections, the arm sections 20*a* and 20*b* can each be channel-shaped with an open bottom. This shape would also tend to hide the wiring 40, particularly if the support arm is properly positioned relative to the picture that is being illuminated. In the case of a channel-shaped arm section, wire holders can be located inside the arm section to maintain the wire inside of the arm section (not shown).

Figure 6:
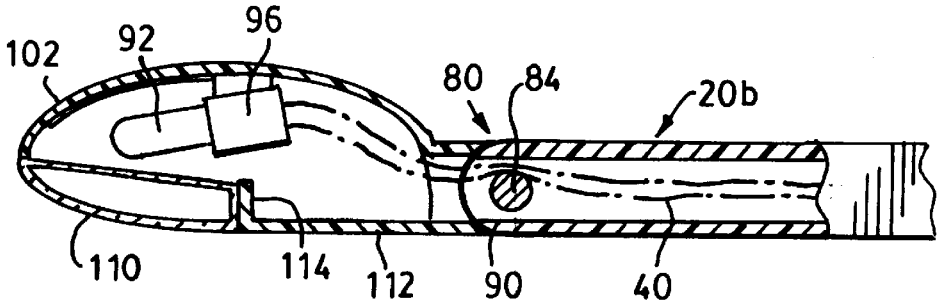
FIG. 6 is a cross-sectional elevation of the electric light receptacle.

The aforementioned light receptacle 22 is pivotably connected to the second arm section 20B at a joint indicated generally at 80 in FIG. 5. This joint is located about midway along an elongate rear edge portion 82 of the receptacle. The joint 80 can be constructed in a manner similar to the joint 66 shown in FIG. 6. This joint also has a pivot pin 84 which extends through two, separated pin holding sections 86 and 88 formed on the outer end of the second arm section 20*b*. The pin also extends through a pin holder 90 formed on the rear edge section of the light receptacle.

The preferred illustrated receptacle 22 holds two relatively small light bulbs 92 and 94 that are mounted in suitable light bulb holders 96 which in turn are secured in the receptacle. Also mounted on the receptacle is a standard on-off switch 98 which is part of the electrical circuit 24. This switch can be mounted on a sidewall 100 of the receptacle.

The preferred light receptacle has a plastic housing indicated generally at 102. This housing has an elongate top which is curved in transverse cross-section illustrated in FIG. 6. Mounted on the inside of this top can be two rectangular pieces of reflective film 104. This film, which can be secured in place by adhesive, forms a reflector which directs the light from each bulb downwardly towards the picture or display. Preferably the light passes through a clear, plastic prismatic lens 110 which can be made of tough, durable acrylic. The receptacle housing is formed with a bottom wall 112 with an upwardly extending flange 114 which supports a rear edge section of the lens 110. The bottom wall 112 extends the entire length of the receptacle and is connected at each end to the sidewalls 100. Thus, both the bulbs and the wiring in the receptacle are completely enclosed by the receptacle. Preferably the bulbs are high efficiency bulbs in order to reduce the amount of electrical power drawn from the batteries.

It will be appreciated that various modifications and changes can be made to the described illumination device without departing from the spirit and scope of this invention. Accordingly, all such modifications and changes as fall within the scope of the accompanying claims are intended to be part of this invention.

I claim:

1. An illuminating device for mounting on a picture frame, said device comprising:

an elongate housing capable of holding at least one battery therein and having a pivot pin connection on an upper side of said housing and located about midway along the length of said housing, said elongate housing being substantially cylindrical;

at least one support wing rigidly connected to said housing and projecting downwardly from a lower section of said housing, said at least one support wing being substantially planar and extending substantially tangentially from said lower section of the housing;

a hollow support arm pivotably connected at an inner end thereof to said pivot pin connection;

an electric light receptacle mounted on an outer end of said support arm and capable of holding at least one light bulb; and an electrical circuit for operating said at least one light bulb by operatively connecting said at least one light bulb to said at least one battery during use of the device, said electrical circuit including electrical wiring extending through said support arm and an on-off switch, wherein said at least one support wing is integrally formed on said housing which is made of rigid plastics material.

2. An illuminating device according to claim 1 wherein said support arm has first and second elongate arm sections that are pivotably connected to each other at a joint located about midway along the length of the support arm.

3. An illuminating device according to claim 1 wherein said pivot pin connection projects upwardly from said upper side of said housing and has a wire passageway formed centrally therein for passage of said electrical wiring therethrough.

4. An illuminating device according to claim 1 wherein said housing is capable of holding three batteries arranged end-to-end and substantially axially aligned.

5. An illuminating device according to claim 1 wherein there are two support wings both integrally formed on said housing and located at opposite end sections of said housing.

6. An illuminating device according to claim 5 wherein said pivot pin connection projects upwardly from said upper side of said housing and has a wire passageway formed centrally therein for passage of said electrical wiring therethrough.

7. An illuminating device for mounting on a picture frame, said device comprising:

an elongate housing capable of holding at least one battery therein and having a pivot pin connection on an upper side of said housing and located about midway along the length of said housing, said elongate housing being substantially cylindrical;

at least one support wing rigidly connected to said housing and projecting downwardly from a lower section of said housing, said at least one support wing being substantially planar and extending substantially tangentially from said lower section of the housing;

a hollow support arm pivotably connected at an inner end thereof to said pivot pin connection;

an electric light receptacle mounted on an outer end of said support arm and capable of holding two small high efficiency light bulbs, said electric light receptacle including a clear plastic prismatic lens arranged so as to cover the two light bulbs when they are mounted in the receptacle; and an electrical circuit for operating said light bulbs by operatively connecting said light bulbs to said at least one battery during use of the device, said electrical circuit including electrical wiring extending through said support arm and an on-off switch.

8. An illuminating device for mounting on a picture frame, said device comprising:

an elongate housing capable of holding at least one battery therein and having a pivot pin connection on an upper side of said housing and located about midway along the length of said housing, said elongate housing being substantially cylindrical;

at least one support wing rigidly connected to said housing and projecting downwardly from a lower section of said housing, said at least one support wing being substantially planar and extending substantially tangentially from said lower section of the housing;

a hollow support arm pivotably connected at an inner end thereof to said pivot pin connection;

an electric light receptacle mounted on an outer end of said support arm and capable of holding at least one light bulb; and an electrical circuit for operating said at least one light bulb by operatively connecting said at least one light bulb to said at least one battery during use of the device, said electrical circuit including electrical wiring extending through said support arm and an on-off switch, wherein said housing has a battery cover detachably mounted on one side of said housing, said battery cover being curved in the transverse direction of the length of said housing with said cover's radius of curvature corresponding substantially to that of the housing.

9. A picture lamp for lighting a picture or display mounted in a picture frame to be hung on a wall, said lamp comprising:

an elongate, tubular housing having a substantially cylindrical exterior and capable of holding two or more batteries in an end-to-end manner, two substantially flat support wings rigidly connected to a lower section of said housing and arranged to project downwardly from said housing during use of said lamp, said support wings being integrally formed on said lower section of said tubular housing and located on opposite end sections of said lower section;

an elongate support arm pivotably connected to said housing at an upper and central section of said housing;

an electric light receptacle mounted on an outer end of said support arm and capable of holding at least one bulb; and an electrical circuit for operating said at least one light bulb by operatively connecting said at least one light bulb to said two or more batteries during use of said lamps, said electrical circuit including electrical wiring extending along said support arm and an on-off switch, wherein said picture lamp is adapted to rest on a top portion of said picture frame when said picture frame has been hung on a wall and wherein, in this position, said support wings can extend downwardly between said wall and a rear surface of said picture frame in order to hold the picture lamp on said top portion of the picture frame.

10. A picture lamp according to claim 9 wherein said support wings extend substantially horizontally from said lower section of the housing.

11. A picture lamp according to claim 9 wherein said tubular housing has an integral lug-type connector projecting upwardly therefrom and having a pivot pin hole formed therein and an inner end of said support arm is connected to said connector by means of a pivot pin.

12. A picture lamp according to claim 11 wherein said support arm has first and second elongate arm sections that are pivotably connected to each other at a joint located approximately midway along the length of the support arm.

13. A picture lamp for lighting a picture or display mounted in a picture frame to be hung on a wall, said lamp comprising:

an elongate, tubular housing having a substantially cylindrical exterior and being capable of holding two or more batteries in an end-to-end manner;

at least one support wing rigidly connected to a lower section of said housing and arranged to project downwardly from said housing during use of said lamp;

an elongate support arm pivotably connected to said housing at an upper and central section of said housing, an electric light receptacle mounted on an outer end of said support arm and capable of holding two small light bulbs said receptacle including a clear, plastic prismatic lens arranged so as to cover the two light bulbs when they are mounted in said receptacle; and an electrical circuit for operating said light bulbs by operatively connecting said light bulbs to said two or more batteries during use of said lamp, said electrical circuit including electrical wiring extending along said support arm and an on-off switch, wherein said picture lamp is adapted to rest on a top portion of said picture frame when said picture frame has been hung on a wall and wherein, in this position, said at least one support wing can extend downwardly between said wall and a rear surface of said picture frame in order to hold the picture lamp on said top portion of the picture frame.

14. A picture lamp according to claim 13 wherein said on-off switch is mounted on a side of said receptacle.

* * * * *